US006253915B1

(12) United States Patent
Mesica et al.

(10) Patent No.: US 6,253,915 B1
(45) **Date of Patent: *Jul. 3, 2001**

(54) PROTECTIVE FIREARM POUCH

(76) Inventors: Zuri Mesica, 4063 Benedict Canyon Dr., Sherman Oaks, CA (US) 91423; James Stafford, 6295 Critenden St., Cincinnati, OH (US) 45244

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/357,195

(22) Filed: Jul. 20, 1999

(51) Int. Cl.[7] ..... B65D 85/00

(52) U.S. Cl. ..... 206/317; 224/192; 224/245; 224/911

(58) Field of Search ..... 206/317; 224/192, 224/245, 911

(56) References Cited

U.S. PATENT DOCUMENTS

| | | | | |
|---|---|---|---|---|
| 4,463,847 | * | 8/1984 | Gordon | 224/911 |
| 4,466,537 | * | 8/1984 | McMahan | 206/317 |
| 4,522,871 | * | 6/1985 | Armellino, Jr. et al. | 428/252 |
| 4,877,131 | * | 10/1989 | Patros | 206/317 |
| 5,149,203 | * | 9/1992 | Sacks | 206/317 |
| 5,584,424 | * | 12/1996 | Stava | 224/240 |
| 5,924,565 | * | 7/1999 | Colee | 206/317 |

* cited by examiner

*Primary Examiner*—David T. Fidei
(74) *Attorney, Agent, or Firm*—Oppenheimer Wolff & Donnelly, LLP

(57) ABSTRACT

A protective pouch for firearms includes a compartment defined by front and rear faces and a peripheral face between the front and rear faces. A zipper opening mechanism provides access to the inside of the pouch. The pouch is constructed of a fabric-like material having bulletproof characteristics. The pouch includes a mechanism for securing a firearm within the pouch. A lock may also be included to restrict access to the contents of the pouch.

13 Claims, 3 Drawing Sheets

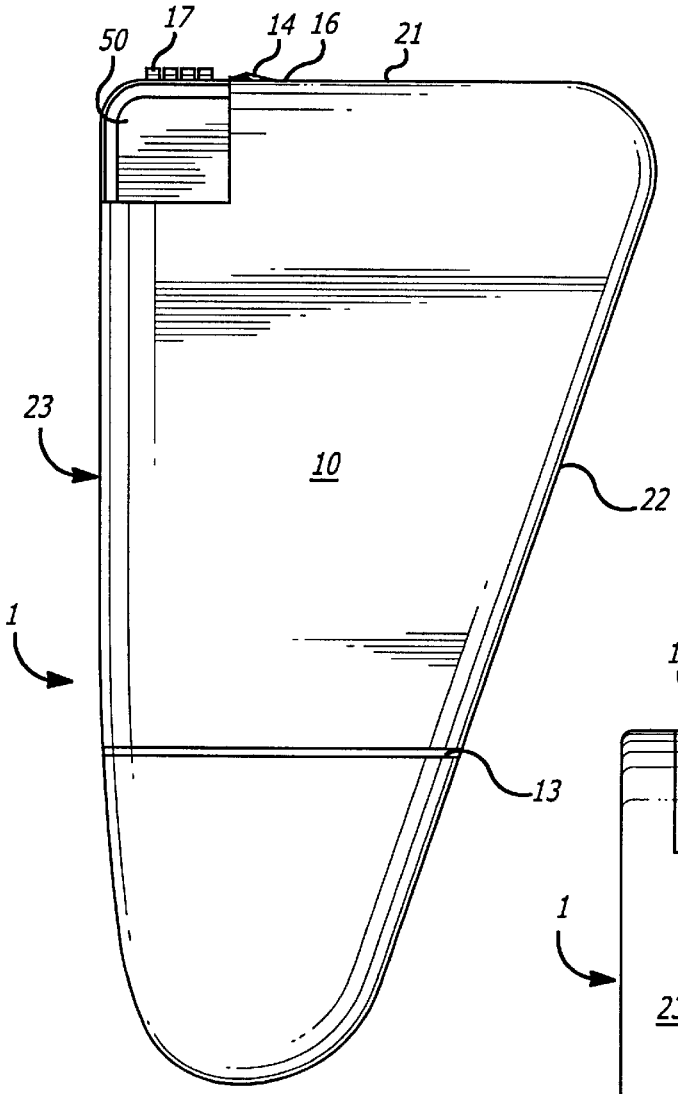
FIG. 2
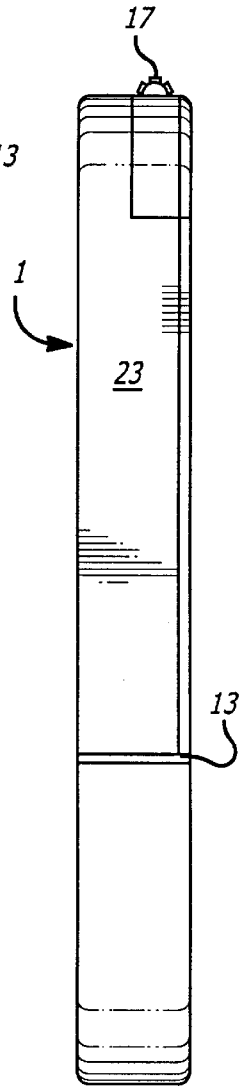
FIG. 4
FIG. 3
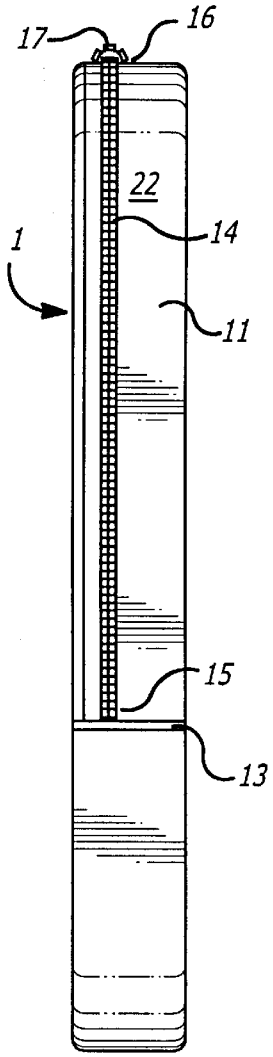

FIG. 6
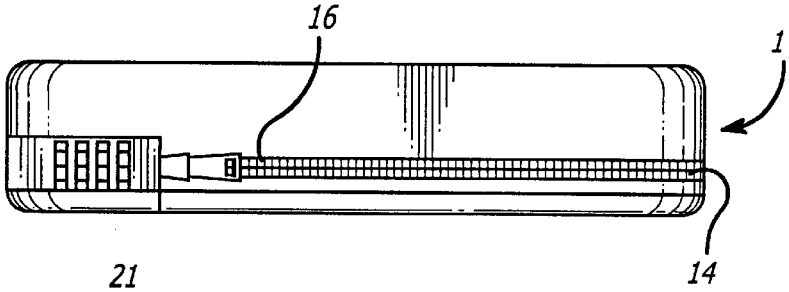
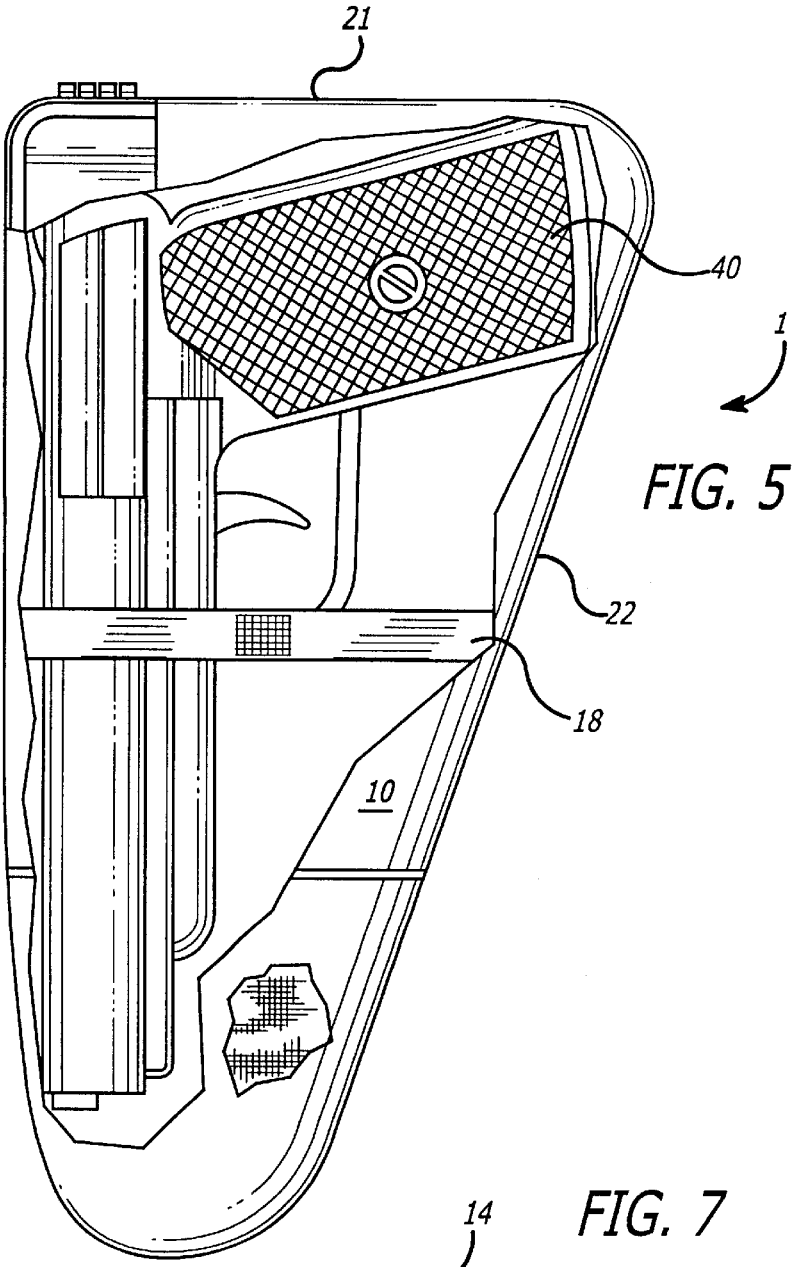
FIG. 5
FIG. 7
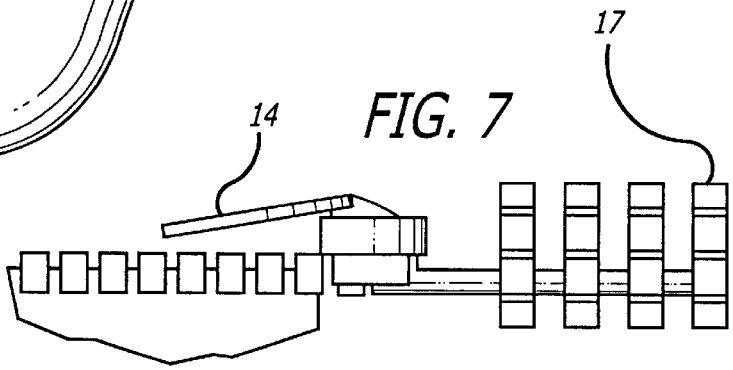

PROTECTIVE FIREARM POUCH

FIELD OF THE INVENTION

The invention is directed generally to firearm pouches and, more particularly, to a firearm pouch in which the casing is made from a tough, bulletproof material which prevents access to unauthorized users.

BACKGROUND OF THE INVENTION

Long firearm pouches for rifles are, of course, well known to facilitate their transport. Similarly known are pouches for handguns. Examples of handgun pouches are, for example, disclosed in U.S. Design Pat. No. D262,231 which shows a firearm cylinder pouch and U.S. Pat. No. 5,294,031, which shows a discreet pistol pouch serving as a concealed gun holster.

Such pouches however have virtually served no other purpose than simply to carry a weapon in a concealed manner. The pouches are not necessarily safe from, for example, an unauthorized entrant into the pouch. Further, the firearm could inadvertently discharge in the pouch, causing grave harm or even killing a person in the vicinity.

Handgun safety is a national concern, particularly since "the right to bear arms" is arguably granted in the Second Amendment. Further, with the recent tragedy at Columbine High School in Littleton, Colo., preventing easy accessibility of firearms, by children in particular, is of paramount national importance.

It is therefore an object of the invention to provide a protective firearm pouch, which lessens the dangers from an inadvertent discharge of the firearm.

Another object of the invention is to provide a protective firearm pouch, which is not accessible, except to an authorized entrant—for example by one with the correct combination or key to a locking mechanism on the pouch

SUMMARY OF THE INVENTION

These and other objects of the invention, which shall be hereafter apparent, are achieved by the protective firearm pouch having substantially triangular shaped front and back faces and a substantially rectangular shaped peripheral face, connecting the front and back faces. The material in the faces is preferably constructed of very hard fabric-like material, which has bullet proof characteristics such as the material sold under the mark KEVLAR®.

Secured to the right face and a substantial length of upper face is a zipper under an overlapping flap for opening the pouch and accessing the firearm. The firearm is secured to the pouch by a strap having complementary Velcro® mating surfaces. The pouch further includes a locking mechanism, preferably a combination lock which interfaces with zipper to keep the pouch closed to unauthorized entrants.

BRIEF DESCRIPTION OF THE DRAWINGS

The invention will be better understood by a Detailed Description of the Preferred Embodiment, when read with reference to the drawings, in which:

FIG. 2 is a side view of the firearm pouch shown in a closed position;

FIG. 3 is an end view of a sloping plane of the gun pouch;

FIG. 4 is a rear view of the gun pouch;

FIG. 5 is a cutaway side view of the firearm pouch showing firearm secured by the strap;

FIG. 6 is an elevational view of end of the firearm pouch showing a combination lock and a zipper mechanism secured thereto; and FIG. 7 is a simplified schematic view of a zipper of the pouch and how it interfaces with combination lock.

DETAILED DESCRIPTION OF THE PREFERRED EMBODIMENT

Figure 1:
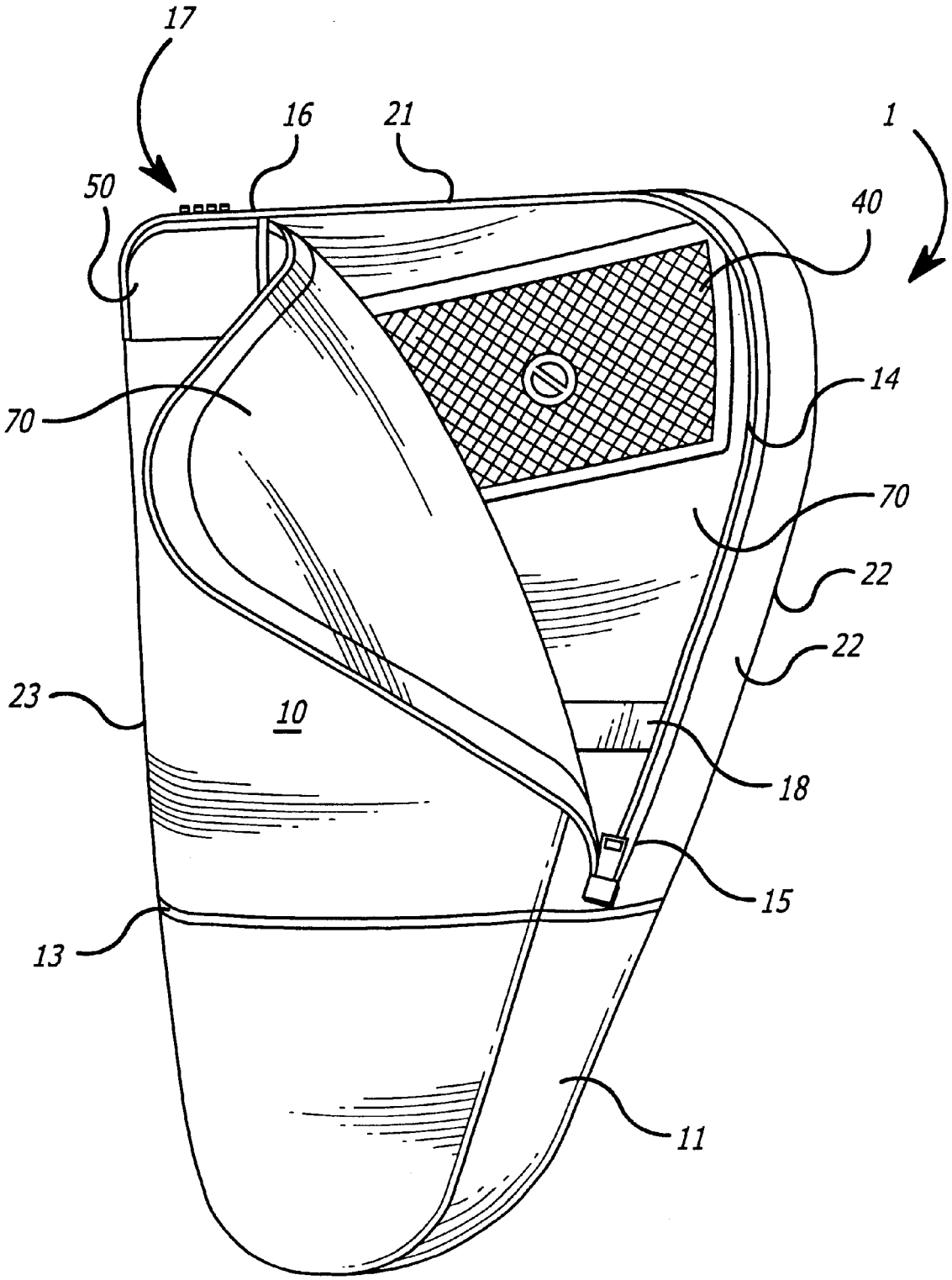
FIG. 1 is an open perspective view of the firearms pouch showing a firearm inside and an internal strap for securing the weapon in the pouch.

Referring now to the drawings, wherein like numerals reflect like elements throughout the various view, FIG. 1 generally shows a substantially triangular-shaped firearm pouch 1 having substantially triangular shaped front 10 and back 30 faces and a substantially rectangular shaped peripheral face 11, connecting the front 10 and back 20 face. Peripheral face 11 has an upper face 21, a right face 22 and a left face 23. The material in the faces is preferably constructed of very hard fabric-like material which has bullet proof characteristics such as the material sold under the mark KEVLAR®. Other materials marketed under other marks are also known. It should be understood that although Kevlar is being referred to herein, it is by no means the only class of materials to be used and references to Kevlar may be substituted by other brands or types of material having the characteristics set forth herein.

KEVLAR is a high-strength fiber comprising a long chain-like polymer made by an array of parallely-oriented molecules in a crystalline structure made by an extrusion process. Typically, KEVLAR has a high cut and flame resistance and tensile strength. Kevlar and other "soft armor material" have been tested by various groups for ballistic resistance. The magnitude of ballistic resistance has been classified into various levels by the National Institute of Justice. A table delineating the levels is below:

| Type | Bullet caliber and type | Bullet mass (grains) | impact velocity* (ft/s) |
|---|---|---|---|
| I | .22 long rifle high-velocity | 40 | 1,050 |
| | .38 round-nose lead | 158 | 850 |
| II-A | .357 jacketed soft-point | 158 | 1,250 |
| | 9-mm full metal jacket | 124 | 1,090 |
| II | .357 jacketed soft-point | 158 | 1,395 |
| | 9-mm full metal jacket | 124 | 1,175 |
| III-A | .44 magnum lead semi-wadcutter gas-checked | 240 | 1,400 |
| | 9-mm full metal jacket | 124 | 1,400 |
| III | 7.62 mm full metal jacket | 150 | 2,750 |
| IV | .30-06 armor-piercing | 166 | 2,850 |
| Special | custom | custom | custom |

*Minimum velocity; the maximum velocity for a fair hit is 50 ft/s greater.

The material for the protective pouch herein could be uniform or could consist of different types and gradations of strength, and could be separated, for instance, by a seam 13 as shown and FIGS. 1 and 2. Preferably, additional amounts of KEVLAR or other stronger material should be at the discharge end of the weapon in the pouch.

Secured to the right face 22 and a substantial length of upper face 21 is an opening mechanism, preferably a zipper 14 for opening the pouch and accessing the firearm 40. The zipper may either be stitched and/or heat sealed. Zipper 14 begins at an initial end 15 and may be used to close the pouch by pulling it to a distal end 16 and is securable there to a locking mechanism generally depicted by 17. The zipper 14 is covered by an overlapping flap construction as shown by flap 70 having a leading edge indicated by dashed lines.

As shown in particularly FIG. 5, firearm 40 is secured to the pouch by a strap at 18, preferably having complementary Velcro® mating surfaces having (preferably on the underside of the strap 18 on the right as shown in FIG. 5).

In one corner of the pouch 1, near the back end of the firearm, is a rectangular piece 50 made of strong material to reinforce the lock area. Into this rectangular piece 50 is constructed the locking mechanism, which is also shown in FIGS. 3 and 4 and depicted in greater detail in FIG. 7 and can be of various types.

In a preferred embodiment, shown in FIG. 7, the mechanism 17 comprises combination lock tumblers 19, which facilitates the movement of a male pin 20 which slides into tumblers 19 to thereby lock it. The figure shows a simple side view of the zipper 14 as it interfaces with combination lock. This interface is shown in FIG. 6, which is an elevation view with the combination lock.

While the preferred embodiment of the invention has been depicted in detail modification and adaptations may be made thereto, without departing from the spirit and scope of the invention as shown in the following claims:

What is claimed is:

1. A protective firearm holder, comprising:

a substantially closed compartment having approximately a triangular shape for holding a firearm, said compartment defined by having a substantially planar front and rear face and a peripheral face between at least a portion of said front and rear face, wherein said front and rear face and said peripheral face are substantially bulletproof;

an opening mechanism disposed along a first side and a second side of said peripheral face to provide access to said holder along said peripheral face;

a firearm securing member within said compartment; and a locking mechanism for locking said opening mechanism.

2. The protective firearm holder of claim 1, wherein said peripheral face connects said front and rear faces.

3. The protective firearm holder of claim l, wherein said compartment includes at least one substantially bulletproof layer having a hard material which has bulletproof characteristics.

4. The protective firearm holder of claim 1, wherein said firearm securing member comprises a strap having complementary mating surfaces.

5. The protective firearm holder of claim 3, wherein the at least one layer offers at least a Type I ballistic resistance.

6. The protective firearm holder of claim 3, wherein the at least one layer offers at least a Type III ballistic resistance.

7. A protective firearm holder, comprising:

a substantially closed compartment for holding a firearm, said compartment defined by having a substantially planar front and rear face and a peripheral face between at least a portion of said front and rear face, wherein said front and rear face and said peripheral face are substantially bulletproof;

an opening mechanism disposed along a portion of said peripheral face;

a firearm securing member within said compartments said firearm securing member including a strap having complementary mating surfaces; and a locking mechanism for locking said opening mechanism.

8. The protective firearm holder of claim 7, wherein said peripheral face connects said front and rear faces.

9. The protective firearm holder of claim 7, wherein said compartment includes at least one substantially bulletproof layer having a hard material which has bulletproof characteristics.

10. The protective firearm holder of claim 9, wherein the at least one layer offers at least a Type I ballistic resistance.

11. The protective firearm holder of claim 9, wherein the at least one layer offers at least a Type III ballistic resistance.

12. The protective firearm holder of claim 7, wherein the substantially closed compartment has approximately a triangular shape.

13. The protective firearm holder of claim 7, wherein said an opening mechanism is disposed along a fist side and a second side of said peripheral face to provide access to said holder along said peripheral face.

* * * * *